US005396716A

United States Patent [19]

Smart et al.

[11] Patent Number: 5,396,716

[45] Date of Patent: Mar. 14, 1995

[54] JET TUBE DRYER WITH INDEPENDENTLY CONTROLLABLE MODULES

[75] Inventors: Irma H. Smart, Axton; Michael A. Edmonds, Bassett, both of Va.

[73] Assignee: Smart Machine Technologies, Inc., Martinsville, Va.

[21] Appl. No.: 93,856

[22] Filed: Jul. 20, 1993

[51] Int. Cl.[6] ..... F26B 3/00

[52] U.S. Cl. ..... 34/464; 34/652; 34/554; 34/551

[58] Field of Search ..... 34/636, 638, 639, 640, 34/643, 651, 652, 653, 656, 463–464, 551, 554, 565, 569

[56] References Cited

U.S. PATENT DOCUMENTS

| | | | |
|---|---|---|---|
| 2,640,277 | 6/1953 | Dungler | 34/160 |
| 3,036,385 | 5/1962 | Russell | 34/160 |
| 3,041,739 | 7/1962 | Meir-Windhorst | 34/156 |
| 3,068,586 | 12/1962 | Vaughan et al. | 34/20 |
| 3,633,281 | 1/1972 | Vits | 34/156 |
| 3,793,741 | 2/1974 | Smith, Jr. | 34/48 |
| 4,227,317 | 10/1980 | Fleissner | 34/155 |
| 4,252,133 | 2/1981 | Buske et al. | 34/155 |
| 4,341,024 | 7/1982 | Witkin | 34/155 |
| 4,435,909 | 3/1984 | Williamson, Jr. | 34/155 |
| 4,575,952 | 3/1986 | Bodenan et al. | 34/54 |
| 4,691,450 | 9/1987 | Glaser et al. | 34/155 |
| 5,016,363 | 5/1991 | Krieger | 34/156 |
| 5,150,534 | 9/1992 | Kramer | 34/155 |

OTHER PUBLICATIONS

Brochure entitled "detwister-squeezer AS/CA", ALEA, Burlington Textile Machinery Corp.

Brochure entitled "dryer for terry fabric CA-77S", ALEA, Burlington Textile Machinery Corp.

Brochure entitled "controlled shrinkage dryer CA-85", ALEA, Burlington Textile Machinery Corp.

Brochure entitled "multipass drier with controlled shrinkage Etagen-Trockner mit Regelschrumpf CA-DUPLEX", ALEA, Burlington Textile Machinery Corp.

"Flow Through and Jet Tube Dryers", Smart Machines.

M. Gundappa and T. E. Diller, "Jet Impingement Heat Transfer from Jet Tubes and Orifices", excerpts from presentation given at 1989 Natl Heat Transfer Conference.

M. Gundappa, J. F. Hudson and T. E. Diller, "Jet Impingement Heat Transfer from Jet Tubes and Orifices", 1989 Nat'l Heat Transfer Conference, HTD-vol. 107, pp. 43–50.

*Primary Examiner*—Denise L. Gromada

*Attorney, Agent, or Firm*—Oliff & Berridge

[57] ABSTRACT

A drying apparatus includes a plurality of dryer modules, each module creating a drying zone and having a plurality of tubes disposed above and below an upper surface of a conveyor that supports a product within the apparatus for transport therethrough. At least one circulation fan in each module causes heated air to circulate to the tubes, which direct the air flow to impinge upon and dry the product. Each module also includes a burner for heating the air within the module to a desired temperature. The circulation fan and burner of each module are independently controllable, so that the apparatus can produce an air-flow rate and an air temperature in at least one of the drying zones different than the air-flow rate and air temperature in at least one other of the drying zones.

24 Claims, 9 Drawing Sheets

JET TUBE DRYER WITH INDEPENDENTLY CONTROLLABLE MODULES

BACKGROUND OF THE INVENTION

1. Field of the Invention

The invention relates to hot air dryers, and more particularly to hot air dryers with a plurality of independently controllable drying modules and a plurality of tubes for directing hot air flow.

2. Related Art

Jet tube dryers are known for their ability to direct a large volume of air into intimate and effective contact with web-type products and to handle the return air without inducing uneven secondary drying or temperatures. The intimate contact between primary treating air and the product can be made either gentle or aggressive by adjusting air velocity and other variables. The overall efficiency of any drying operation depends on this intimate contact over a large area and the resulting fast transfer of moisture or heat between the product and the treating air.

FIG. 6 shows the various components found in a double impingement jet-tube dryer. This design includes an oil or gas direct fired unit or a steam or hot oil coil indirect fired unit. The circulating air blower provides a positive pressure in the plenum, which forces air through the tubes at a high velocity. Between the blower and the plenum that distributes the air evenly to the jet tubes is a damper used to control the circulating air volume and the air velocity in the jet tubes. The entrance to each jet tube is flared to reduce turbulence and entrance losses. Air velocities of several thousand feet per minute are common.

The length of the jet tubes is determined by the space necessary to carry the return air through the forest of tubes at a nominal velocity. This low velocity keeps the return air from competing with the primary air from the jets and causing uneven secondary drying. In a drying operation, air in the plenum and in the tubes is hotter than the return air, and, therefore, no moisture carried by the return air will condense on the plenum or tube surfaces. The product conveyor can be a series of carrying rolls, a tenter, fixed bars, or a belt.

After the circulating air leaves the tube forest, and before it is reheated, the amount of air necessary to carry away the moisture being removed from the product is exhausted. Circulating air is generally filtered at a point between the exhaust and make-up air ports. This is because the circulating air is coolest and at its least volume. The filtering process employs either continuous self-cleaning or quickly replaceable screens.

Sufficient make-up air is usually brought into the dryer just after the filter screen. This location overcomes any negative pressure in the housing caused by exhausted air and also allows the cool air to be heated and well mixed before contacting the product. When heating with oil, this excess fresh air also assists in obtaining complete combustion.

Today, gas/oil combination burners are standard and cost no more than single fired units. Even though only one fuel is used initially, a second fuel can be added at a minimum expense, when needed. A direct fired burner is shown in FIG. 6. These are efficient and usually are acceptable even though the products of combustion are circulated in the air. Indirect burners pass the products of combustion through an air-to-air heat exchanger. Not only are these installations more expensive, but they are less efficient.

The air can be heated by a steam coil or hot oil coil. Steam coil installations are less expensive than direct fired gas installations, while oil coil installations cost somewhat more. The temperature of the heated air is sensed by an air temperature sensing bulb, which controls the burner or coil output and is located in the pressure plenum. Not shown in FIG. 6 are the access doors required for cleaning, maintenance and explosion relief (when necessary). Many dryers are similar to FIG. 6, except that they also have plenums and jets under the product to treat both sides simultaneously.

FIG. 7 shows a tube forest in a double impingement jet tube dryer, which is effective for drying tubular knit products. The material is carried by a flat wire conveyor having an open mesh, which allows the air to penetrate the belt with minimum interference. By increasing the air velocity on the bottom jets, the material can be lifted off the belt to allow unrestricted shrinkage. On suction drum dryers, on the other hand, the product is held tightly to the drum, restricting its ability to shrink. Such is also true on drum dryers where high-velocity air on the outside holds the product on the drum. When only part of the suction drum surface is covered by material, air short circuits through the uncovered areas and reduces drying.

Conversely, the double impingement jet tube dryer shown in FIG. 7 treats the product uniformly, regardless of how much conveyor surface is uncovered. Also, the return air travels in a path through the forest of tubes and is prevented from interfering with the treating air jet stream.

FIG. 8 shows a dryer with air jets located above a closely woven steel belt and with a suction plenum located below. This design uses the "flow-through" principle. The belt creates enough resistance to discourage excessive short-circuiting of the treating air when the belt is only partially covered by the product. With this design, suction is not required to hold the material against the belt for transport, as with a drum dryer. For maximum efficiency, adjustable slides can be supplied to vary the belt open mesh width in direct proportion to a variable web width product mix. The tubular air jets create a uniform application of air on the belt. Any excess treating air returns through the tube forest as in the standard design.

The FIG. 8 design is advantageous for fragile, porous products such as nonwovens, laces, etc., especially if a flat, starched-like final product is desired.

FIG. 9 shows a standard pattern used to assure uniformity of treatment with jet tube dryers. Section A indicates the work area under each air jet tube, approximately 80% of the total treatment area, section B indicates the inactive area under each air jet tube, and section C indicates the inactive collision area between air jets.

If the product is moving under the jet tubes in the direction of the arrows in FIG. 9, it receives uniform treatment after passing under four rows of tubes. If passed under only one row of tubes, stripes of dry and wet product are created. If the product is stopped beneath the jets, the illustrated white areas receive high velocity drying treatment while the shaded areas do not.

A large proportion (80%+) of the total product area receives high velocity air drying treatment at any instant. This feature, combined with the intimate and efficient contact between air and product, accounts for the fast treatment and high overall efficiency of jet tube dryers. The tubes are arranged on an angle to eliminate streaking and provide a uniform distribution of the treating air.

FIG. 10 is a cross section of the product and jet tube section taken on line 10—10 of FIG. 9. Depicted are the relative air velocities at various points in the air projection system. Air emitted from the positive supply plenum through the jet tubes moves at a much higher velocity than the return air. The laminar air flow from the tubes bounces off the product and returns upward into the less positive area within the forest of tubes. For this reason, the return air does not interfere with the high velocity treatment air, nor does it contact the product. This eliminates overdrying of the webs' salvages caused by return air and short-circuiting treatment air, which plagues most other types of dryers. Uniformity across the web can be accomplished with the jet tube dryer, regardless of the web width. On narrow dryers, return air is usually taken to one side; but for wide machines, it is taken to both sides.

Dryers are notorious for being major energy consumers as well as being extremely inefficient, that is, the energy used, as compared to the work actually performed, is quite high. The basic energy losses are:

1. Exhaust

It is necessary to exhaust air from the dryer, in most cases to carry away moisture. Also, in many cases an increased volume of exhaust is necessary to eliminate puffing of air from the end slots of a tenter or conveyor belt dryer into the room, which causes a polluted atmosphere.

Controlling the exhaust is a prime area of concentration, and much has been done in this area. In the average dryer, energy consumed to perform work (measured in BTU's/pound of product) is roughly equal to the energy exhausted. This makes the dryer less than 50% efficient to begin with.

2. Radiation and Leaks Into the Room

Simple repairs to eliminate mechanical leaks from the dryer housing along with proper insulation can be employed to control the radiation factor.

SUMMARY OF THE INVENTION

It is an object of the present invention to provide a drying system capable of drying a product in a more energy-efficient manner than previously available.

It is a further object of the invention to provide a drying system providing heated air flow over a greater width of product, yielding maximum drying efficiency.

To achieve this and other objects, the invention includes a drying apparatus that dries a product, such as a tubular knit product, fed therethrough. The drying apparatus includes a plurality of dryer modules, each module creating a drying zone and including a plurality of tubes disposed above and below an upper surface of a conveyor that supports the product within the apparatus for transport therethrough.

At least one circulation fan in each module circulates a heated gas, such as air, through plenums within the module and into the tubes, which direct the gas to impinge upon and dry the product. At least one exhaust fan expels moisture-laden gas from the modules, and each module includes a burner for heating the air within the module to a desired temperature. Each module also includes at least one self-cleaning filter that collects fibrous material produced by the product. A friction brush sweeps across the at least one filter in response to a signal generated by a differential pressure sensor.

The circulation fan and burner of each module are independently controllable, so that the apparatus can produce an air-flow rate and an air temperature in at least one of the drying zones different than the air-flow rate and air temperature in at least one other of the drying zones.

The jet tubes are more loosely packed in the direction of product flow and are more densely packed in a direction transverse to the product flow direction than previously known, to more efficiently direct heated air over the entire width of the product. Further, the open area at the junctions of the tubes with their respective plenums is reduced, compared to previous designs.

The present invention also includes a method of drying a product supported within and fed through a drying apparatus.

BRIEF DESCRIPTION OF THE DRAWINGS

In general, like reference numerals will be used to denote like elements as between each of the following Figures, wherein.

DETAILED DESCRIPTION OF PREFERRED EMBODIMENTS

Figure 1:
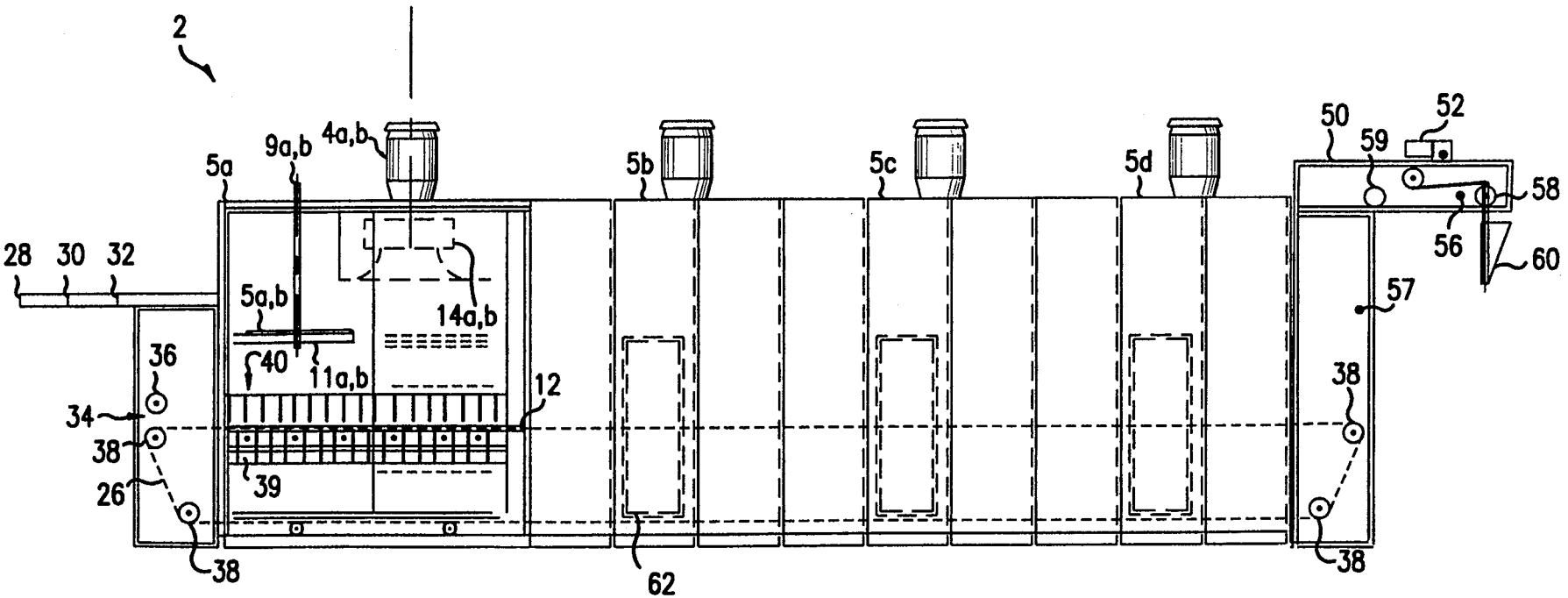
FIG. 1 is a side view of the jet tube drying system of the present invention.
Figure 2:
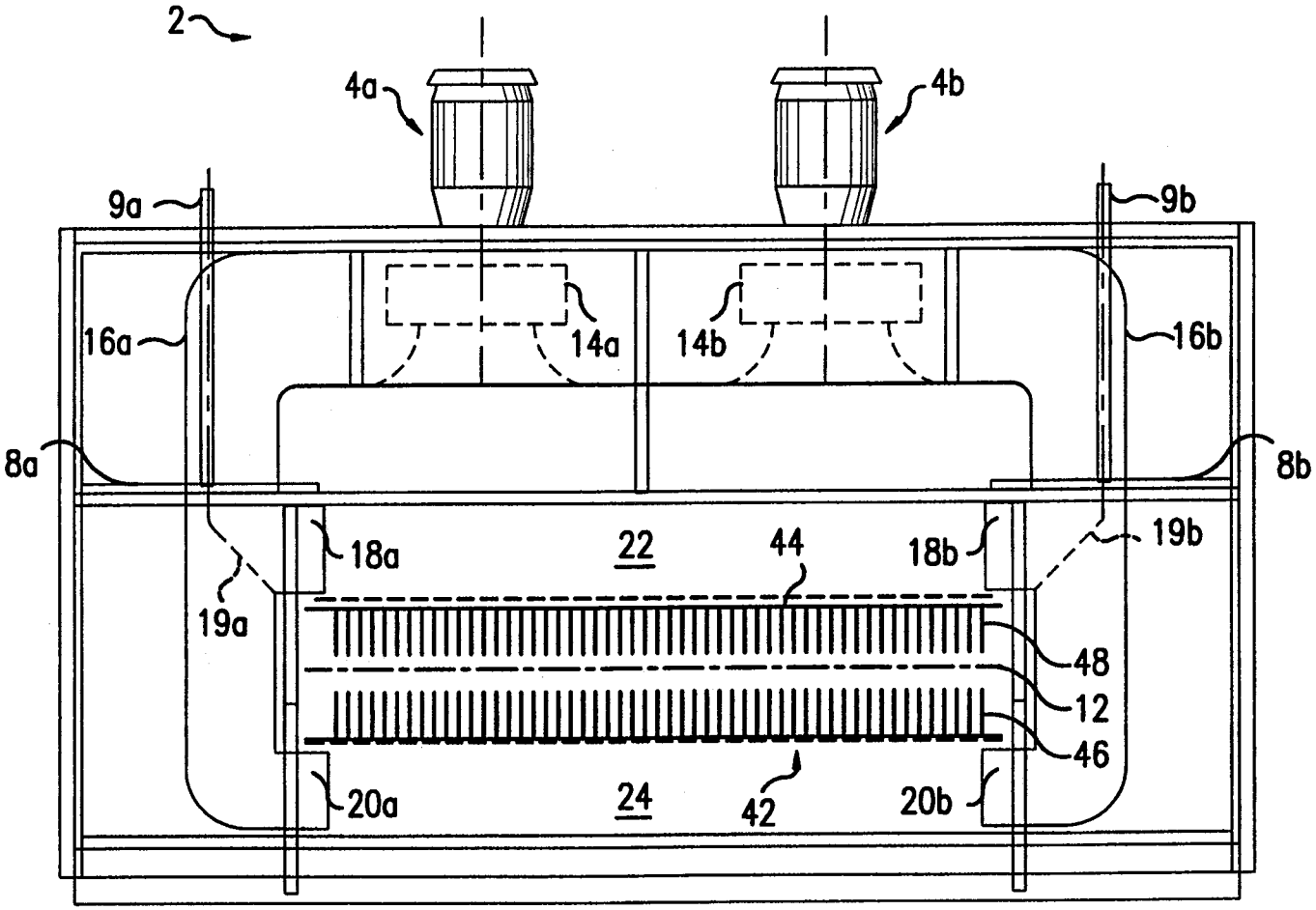
FIG. 2 is an end view showing one dryer module of the present invention.
Figure 3:
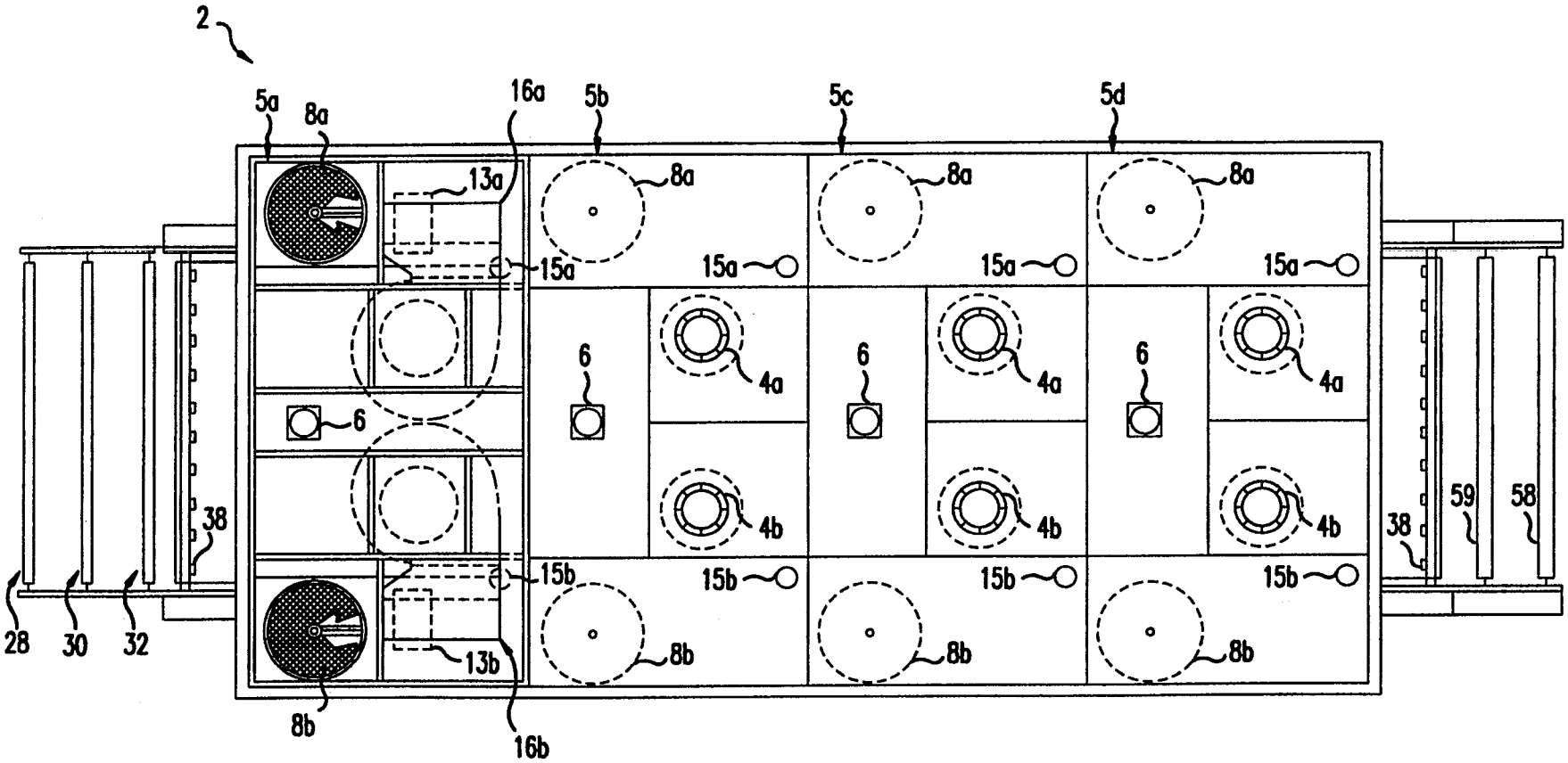
FIG. 3 is a plan view of the jet tube drying system of the present invention.

FIGS. 1–3 show the drying system of the present invention. Dryer 2 comprises a plurality of side-by-side dryer modules 5*a*–5*d*. Each module includes two circulation fans 4*a*, 4*b* disposed on opposite sides of the module, as illustrated in FIGS. 2–3. Circulation fans 4*a*, 4*b* blow air, heated by burner 6, through fan housings 14*a*, 14*b* into distribution ducts 16*a*, 16*b*. The heated air, as directed by adjustment dampers 19*a*, 19*b*, then flows through subducts 18*a*, 18*b*, 20*a*, 20*b* into top and bottom plenums 22, 24, as shown in FIG. 2.

From top and bottom plenums 22, 24, the heated air flows into jet tube forest 40, comprising upper section 44 with individual jet tubes 48 connected to top plenum 22, and lower section 42 with individual jet tubes 46 connected to bottom plenum 24.

Figure 5:
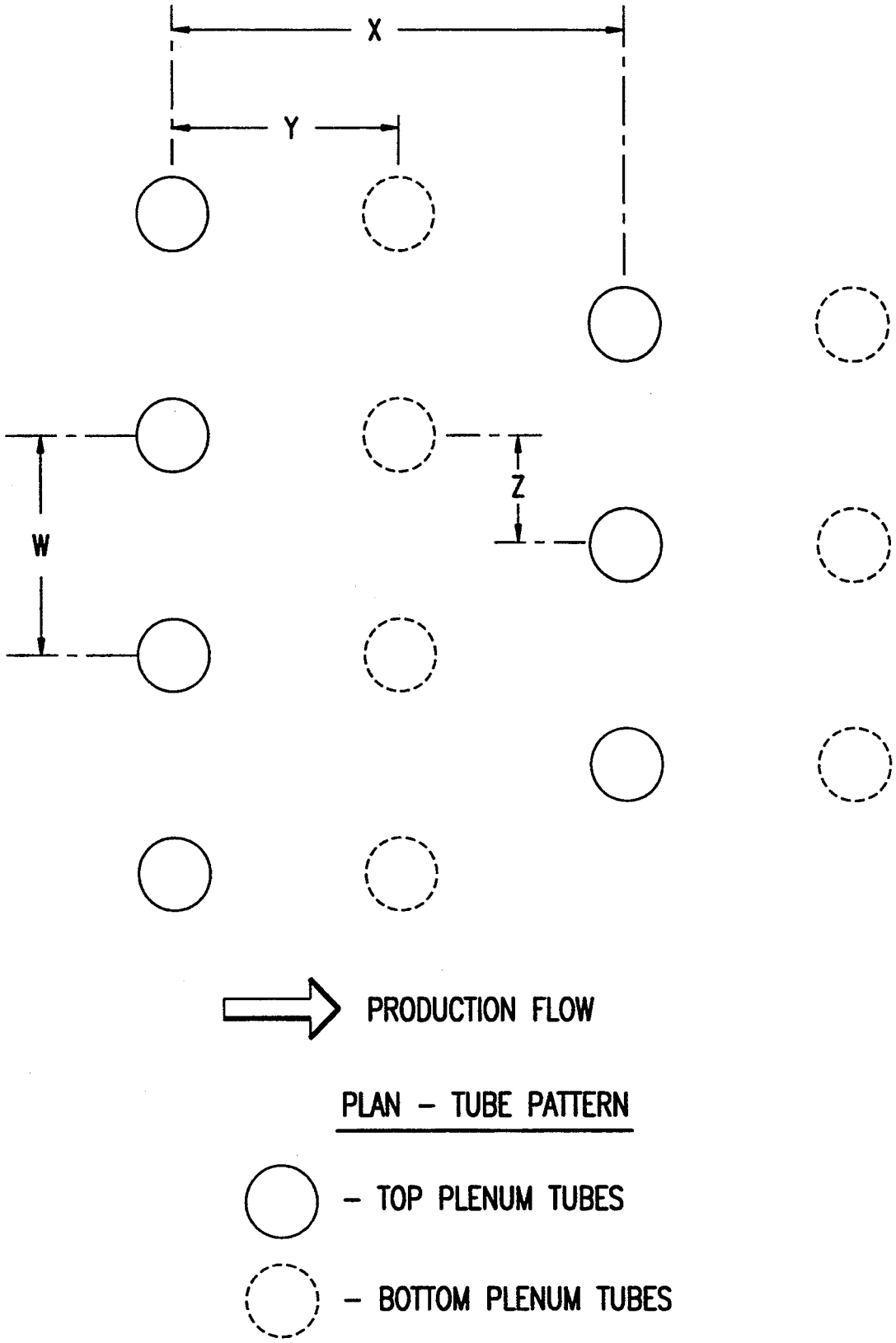
FIG. 5 is a plan view of a preferred embodiment of the jet tube forest of the present invention.
Figure 6:
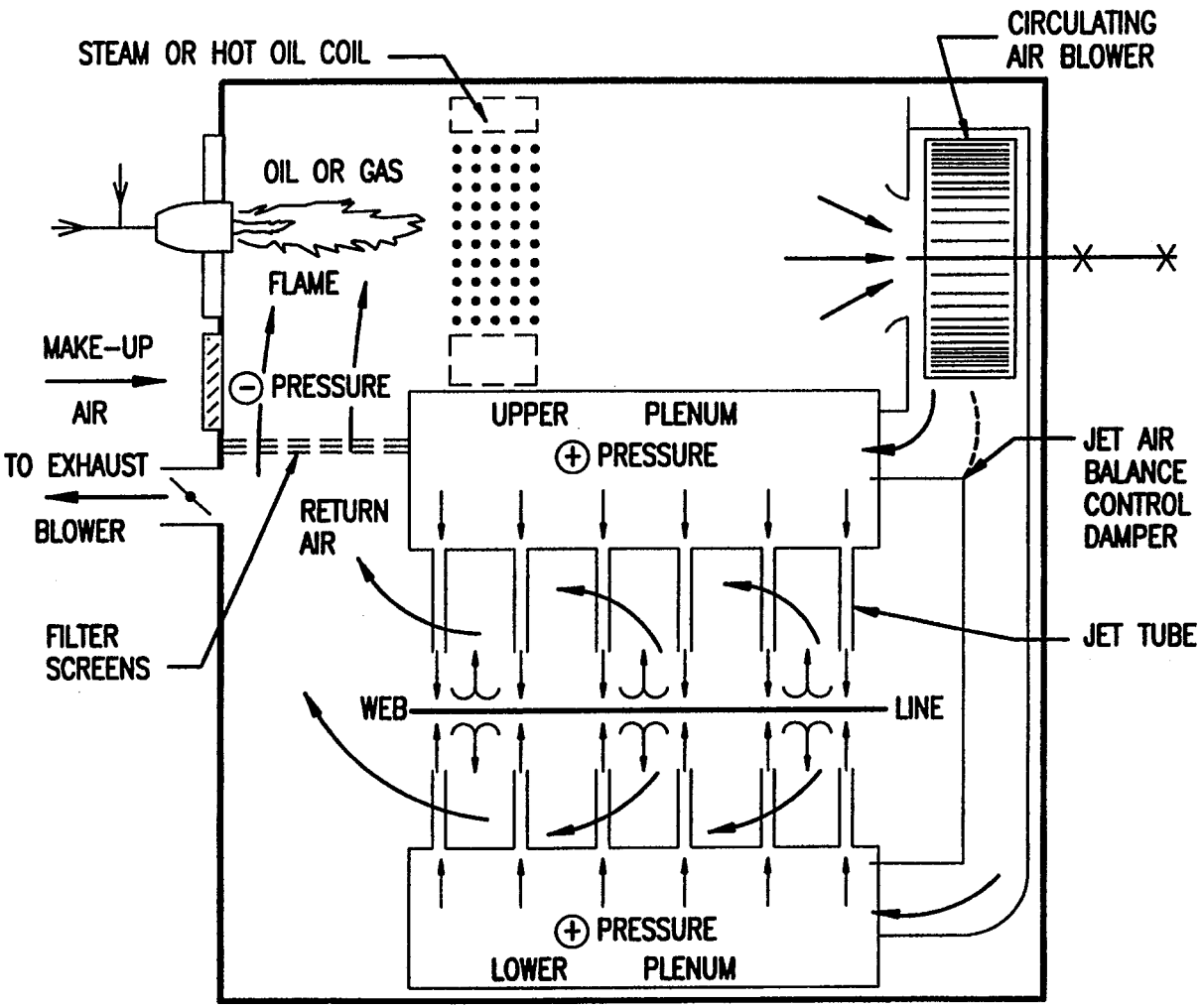
FIG. 6 PRIOR ART
FIG. 6 is a cross sectional view of a conventional double impingement jet tube dryer.
Figure 7:
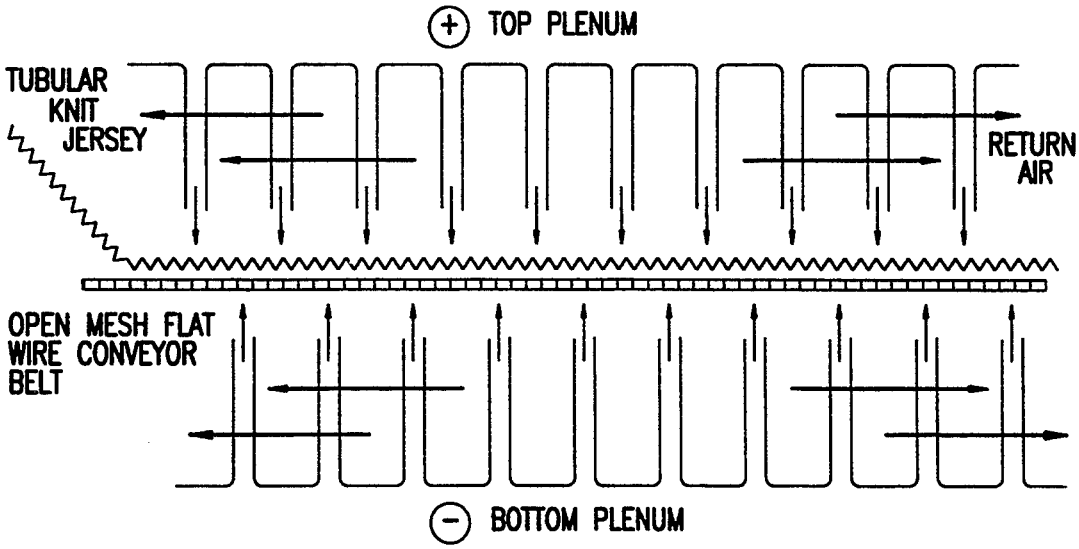
FIG.7 PRIOR ART
FIG. 7 is a side view of a conventional two-sided jet tube dryer.
Figure 8:
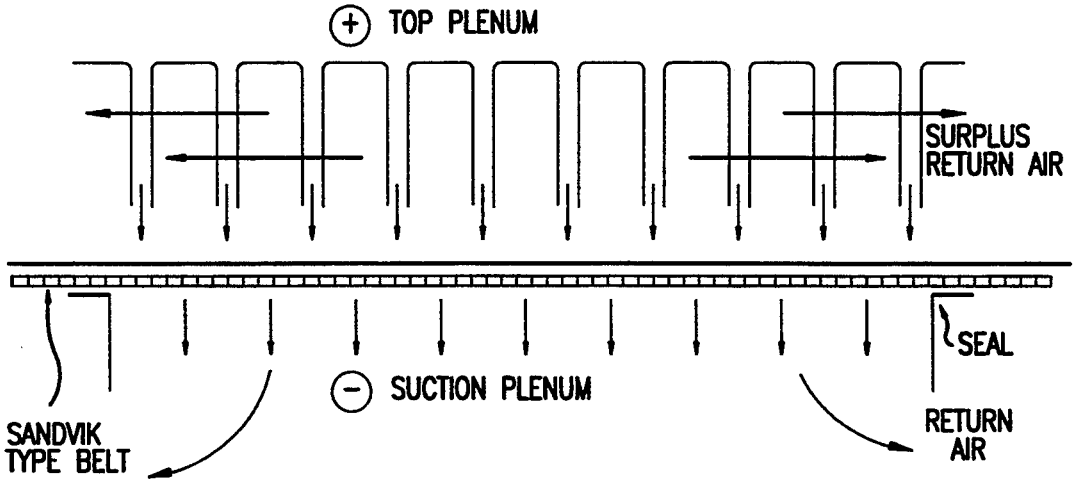
FIG.8 PRIOR ART
FIG. 8 is a side view of a conventional dryer with a suction plenum.
Figure 9:
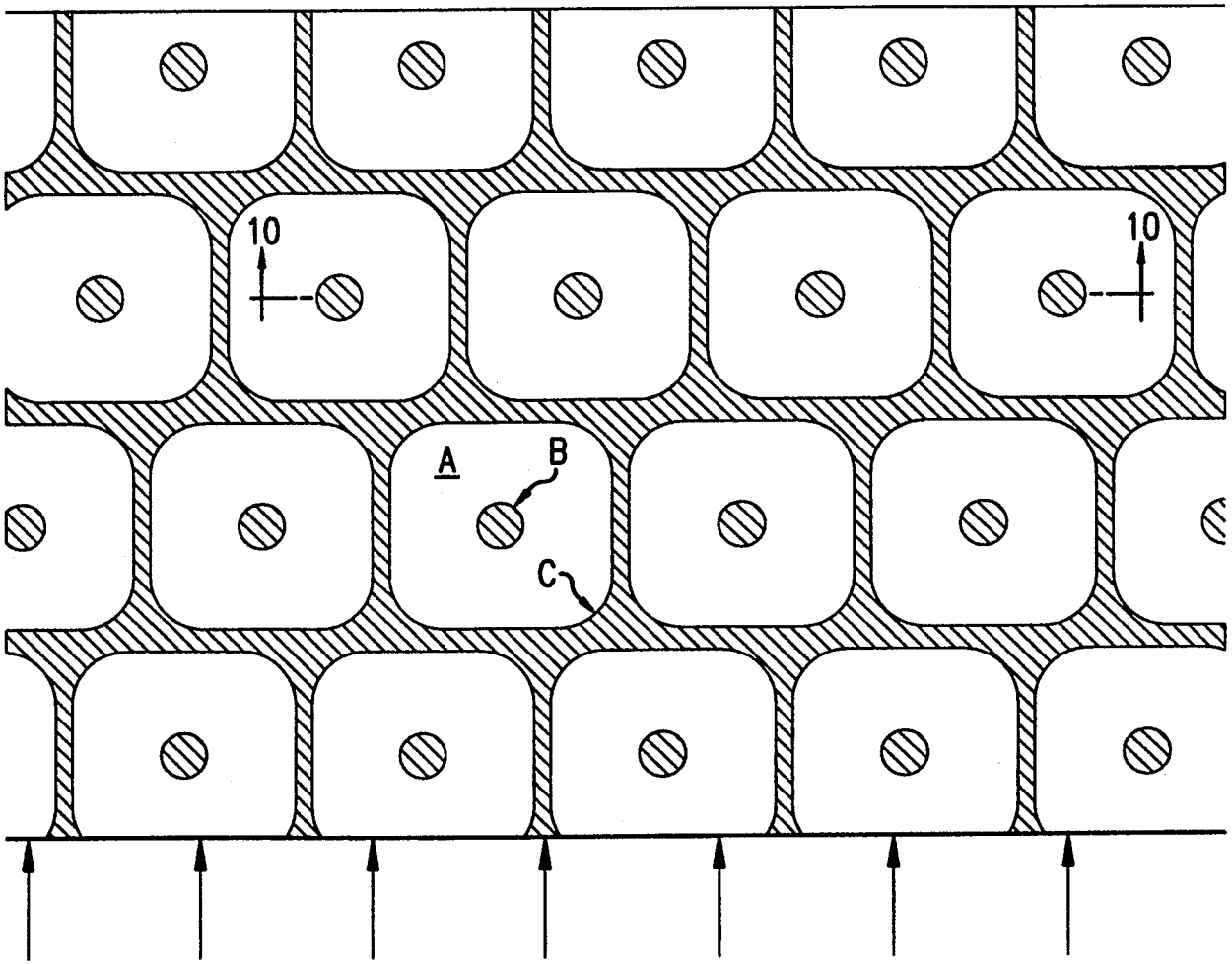
FIG. 9 PRIOR ART
FIG. 9 is a plan view showing the treatment pattern of a conventional jet tube dryer.
Figure 10:
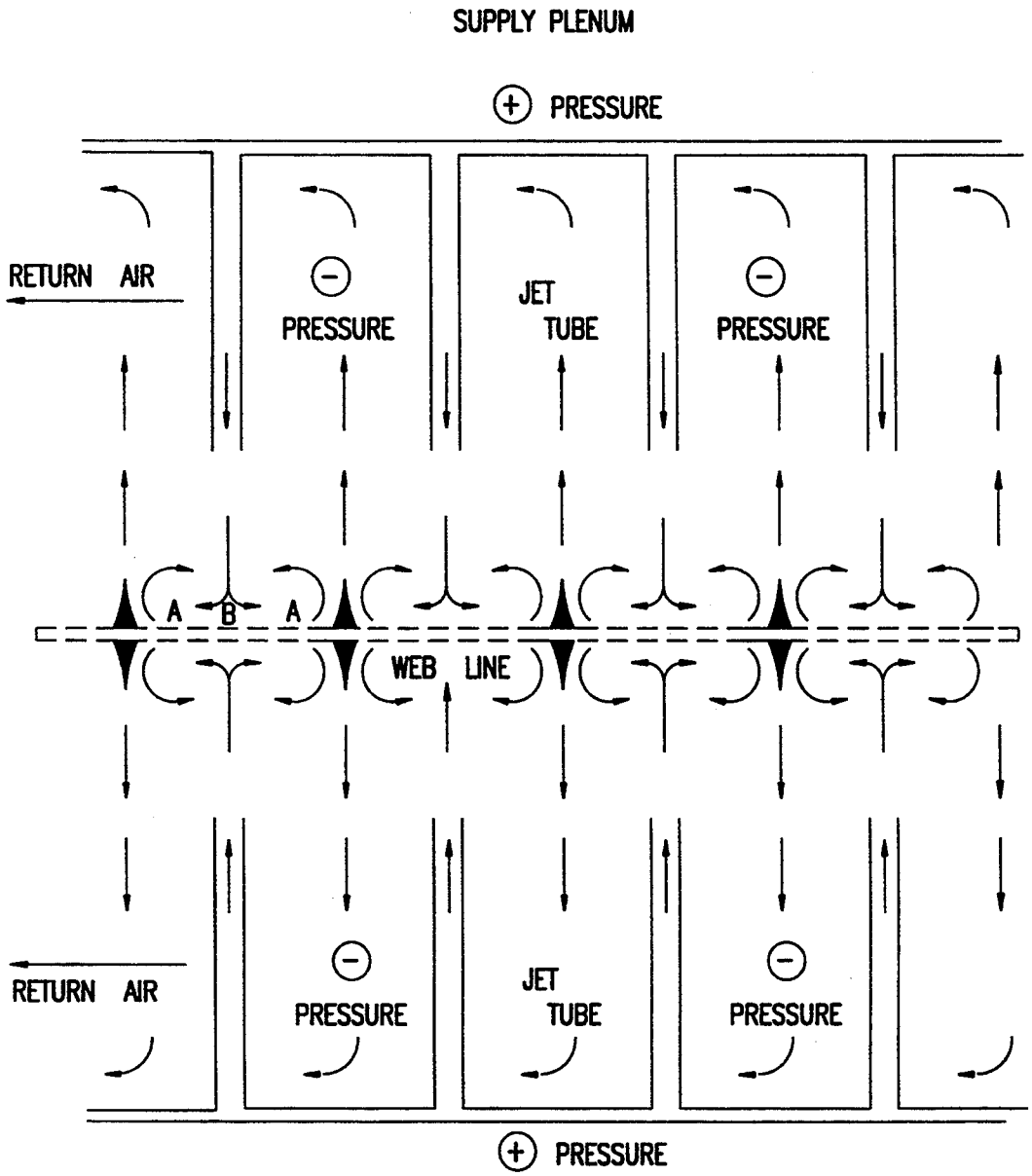
FIG.10 PRIOR ART
FIG. 10 is a sectional view taken on line 10—10 of FIG. 9.

The tubes of the top and bottom plenums 22, 24 are arranged in rows, as shown in FIG. 5. FIG. 5 illustrates the top plenum tubes in solid lines and the bottom plenum tubes in dashed lines. The rows of top plenum tubes 48 are offset with respect to the rows of bottom plenum tubes 46 in the direction of product flow, i.e. the longitudinal direction. This offset between the rows of the top and bottom plenums enhances the sinusoidal pattern imparted to the product to be dried, creating increased drying efficiency. The tubes within each row are spaced transversely, i.e. in a direction perpendicular to the longitudinal direction. Further, tubes in each top plenum row are transversely spaced with respect to the tubes in immediately adjacent top plenum rows, and tubes in each bottom plenum row are transversely spaced with respect to the tubes in immediately adjacent bottom plenum rows.

The tubes within each row are spaced apart in the transverse direction by a distance W, which is preferably about 2½", and the rows themselves are spaced in the longitudinal direction by a distance X, which is preferably about 6". The tubes of the top and bottom plenums are offset with respect to each other by a distance Y in the longitudinal direction, which is preferably about 3", and a distance Z in the transverse direction, which is preferably about 1¼", as shown in FIG. 5.

As described above, offsetting the top plenum tubes from the bottom plenum tubes in the longitudinal direction enhances the sinusoidal shape imparted to the product, allowing shrinkage to be better controlled. Further, jet tube forest 40 represents an improvement over the prior art in that the tubes are more densely packed in the transverse direction and more loosely packed in the longitudinal direction, achieving more efficient drying over a greater width of the product. Finally, the surfaces of the top and bottom plenums 22, 24 closest to the conveyor have an open area, that is, an area occupied by openings of the tubes 46, 48, of only approximately 2%, yielding greater drying efficiency than previously known.

Tube forest 40 directs heated air to impinge upon the product to be dried, which is carried in conveying plane 12 by conveyor belt 26, as described below. Contact between the heated air and the product tends to dry the product, causing the air reflected from the product to become moisture-laden. This moisture-laden air passes between the individual tubes 46, 48 of jet tube forest 40 and is subsequently pulled out the sides of the forest 40, as viewed in FIG. 2. The air is then directed through filters 8*a*, 8*b* for the removal of fibrous material, such as lint, emanating from the product and carried by the air flow.

Figure 4:
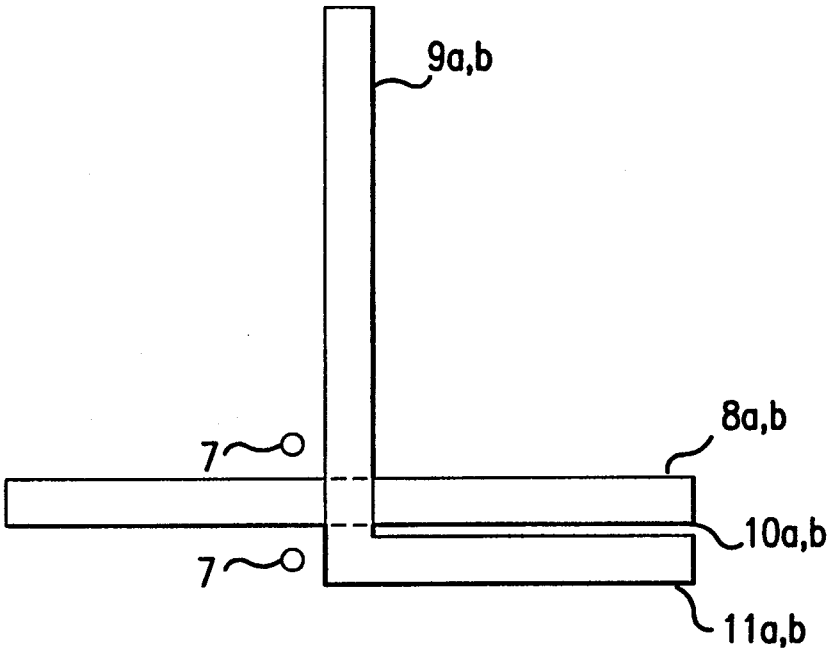
FIG. 4 is a side view of an automatic filter cleaner of the present invention.

As shown in FIG. 4, elements 7 of a differential pressure sensor are positioned on opposite sides of the filters 8*a*, 8*b*. When the pressure difference between the upstream and the downstream sides of the filters 8*a*, 8*b* reaches a predetermined level, for example, 50%, the sensor issues a signal indicating that the particular filter 8*a* or 8*b* is clogged with fibrous material.

In response to the signal from the sensor, brush 10*a* or 10*b* sweeps across the filter 8*a* or 8*b*, removing lint from the filter and causing the lint to fall into lint tray 11*a* or 11*b*. Lint collection fans (not illustrated) create a vacuum, drawing lint from lint trays 11*a*, 11*b* through lint evacuation tubes 9*a*, 9*b*, respectively, and into a common external collection box (not illustrated). Lint evacuation is thus easily and automatically effected.

After passing through filters 8*a*, 8*b*, the moisture-laden air proceeds to an upper section of the module, in the region of exhaust outlets 15*a*, 15*b*. Exhaust fans 13*a*, 13*b* pull off and expel a predetermined amount of the moisture-laden air from the modules through the outlets 15*a*, 15*b*.

In a preferred embodiment, the speed of the exhaust fans is set at the minimum level necessary to effectively dry the product, to maximize energy efficiency. Also in a preferred embodiment, only two exhaust fans 13*a*, 13*b*, positioned over first module 5*a*, are needed to expel moisture-laden air from all the modules 5*a*–5*d* of the dryer 2. Ducts (not illustrated) connect the exhaust outlets 15*a*, 15*b* of each module 5*a*–5*d* to the two exhaust fans 13*a*, 13*b*. Make-up air, compensating for the air expelled by exhaust fans 13*a*–13*b*, flows into the dryer 2 through the openings in which the conveyor belt 26 passes.

After passing through the region of the exhaust outlets 15*a*, 15*b*, the air flow passes burner 6 for further heating and then into circulation fans 4*a*, 4*b*, completing the air flow cycle.

The system for feeding the product through the dryer 2 will now be described. The product to be dried, for example, a tubular knit material, is passed over one or more infeed rolls 28, 30, 32 illustrated in FIG. 1. Infeed rolls 28, 30, 32 aid in removing tubular knit product from a supply, such as a buggy. After looping around idler roll 34, the product passes between idler roll 34 and overfeed roll 36 and from there to the conveyer belt 26. Conveyer belt 26, which in a preferred embodiment is a stainless steel wire belt, is driven around conveyor sprockets 38, 39 to convey the product through each module 5*a*–5*d*.

After exiting the final module 5*d*, the product passes idler roll 57 and enters exit plaiter 50. The product then passes rear pull roll 59, idler roll 56, front pull roll 58 and is directed into chute 60, which is selectively swingable into a plurality of positions by gear motor 52.

Each module 5*a*–5*d* is provided with two access doors 62, one on each side, allowing easy entrance to the equipment housed within each module.

An important feature of the present invention is the ability of each module 5*a*–5*d* to independently control air flow and air temperature. Fans 4*a*, 4*b* and burner 6 of each module 5*a*–5*d* are independently controllable to operator-desired levels to adjust the air-flow rate and the air temperature within each module. In this manner, dryer 2 can produce an air-flow rate and an air temperature in at least one of the dryer modules that is different than the air-flow rate and air temperature in at least one other of the dryer modules. Alternatively, the air-flow rate and air temperature can be adjusted to the same levels in each module.

Fans 4*a*, 4*b* and burner 6 can be controlled by a control program that includes parameters based on characteristics of the particular product to be dried. For example, as a product passes through initial modules and partially dries, it becomes lighter in weight. This allows the air flow rate and air temperature used in later modules to be commensurately reduced. The present invention allows this reduction by providing independent control for the fans 4*a*, 4*b* and burner 6 of each module 5*a*–5*d*, minimizing energy costs. By downwardly adjusting the air-flow rate and air temperature of selected downstream modules, energy-efficient drying of the product can be easily accomplished.

Modules 5*a*–5*d* are readily connectable and disconnectable, permitting a variety of dryer configurations. Based on the production results desired, as many or as few modules as desired can be used. The length of conveyor 26 and the output horsepower of its drive motor is varied in accordance with the number of modules used. The greater the number of modules, the greater the drying capacity, but also the greater the energy consumption. Drying capacity is linearly related to product dwell time within the dryer 2; for example, if a dryer having 4 modules can dry 40 yards of product per minute, then a dryer having 6 modules can dry approximately 60 yards of product per minute.

A preferred embodiment of dryer 2 will now be described. The dryer comprises three major components: an infeed section, a standard dryer module or zone, and an exit plaiter. The infeed section is constructed of formed plate and structural steel members. Infeed rolls 28, 30, 32 are formed of aluminum and are preferably about 3" in diameter with a face width of about 120". Overfeed roll 36 is about 8" in diameter and is located in a main frame of the infeed section. Overfeed roll 8 is powered by a 2 HP gear motor, controlled by a variable frequency AC drive. The frame of the infeed section includes cast iron pockets for supporting shafts of infeed section conveyor sprockets 38, one of the shafts being fixed and another of the shafts being adjustable for tensioning belt 26.

The standard dryer modules 5*a*–5*d* are preferably approximately 111" long×207" wide×120" high. As described above, as many modules as necessary can be interconnected to form the dryer 2. Each module is supported by a skeletal frame formed of 2" square structural tubing. Outside this frame are 3" thick tongue and groove insulated panels. These panels are made of 14 GA. HRS frame, 20 GA. Galvannealed skins and filled TIW type II insulation. Access doors 62, provided in each module, are equipped with Brixon explosion relief latches.

Each module has carbon steel rolls of about 4" in diameter supporting stainless steel flat wire belt 26. Belt 26 is preferably about 120" wide and has sufficient open area to allow impingement of heated air from top and bottom plenums 22, 24. The conveyor is driven by a 5 HP gear motor located in the frame of the exit plaiter 50 and controlled by a variable frequency AC drive. The speed ratio between overfeed roll 36 and the conveyor are varied by an operator to achieve optimal product shrinkage during the drying process.

Each module has a double impingement air system designed to achieve maximum transfer and, therefore, maximum drying speed. The two plenums 22, 24 are constructed of 18 GA. galvanized steel. Fans 4*a*, 4*b* are New York Blower 30 PLR fans powered by 30 HP motors. These motors are controlled by variable frequency AC drives to adjust the velocity of the air impinging on the product. Burner 6 is a Maxon 425 ovenpak burner (2.5 MBTU).

Exit plaiter 50 is constructed of formed plate and structural steel members. The frame supports two shafts on which rolls 38 are supported, one being driven and the other being adjustable for tensioning belt 26. Idler rolls 56, 57 are formed of aluminum and are about 3" in diameter; pull rolls 58, 59 are preferably about 8" in diameter. Chute 60 is formed of aluminum. Gear motor 52, which powers the rolls and chute 60, is a 2 HP gear motor controlled by a variable frequency AC drive. Plaiter 50 delivers the product in a folded manner to the operator's buggy or table.

The invention has been described with reference to the preferred embodiments thereof, which are illustrative and not limiting. Various changes may be made without departing from the spirit and scope of the invention as defined in the appended claims.

What is claimed is:

1. A drying apparatus for drying a product fed therethrough, comprising:

at least one conveyor supporting the product within the drying apparatus for transport therethrough; and a plurality of dryer zones, each zone comprising:

a plurality of tubes disposed adjacent to the at least one conveyor, the tubes directing gas to impinge upon the product to tend to dry the product; and at least one circulation fan causing the gas to circulate at a gas-flow rate through the zones to the tubes, the at least one circulation fan of each zone being independently controllable so that the drying apparatus can produce a gas-flow rate at the product in at least one of the dryer zones higher than a gas-flow rate at the product in at least one other of the dryer zones, to tend to dry the product in said at least one zone faster than in said at least one other zone.

2. The apparatus of claim 1, wherein the plurality of tubes is disposed above and below an upper surface of the conveyor, so that the gas impinges upon oppositely disposed regions of the product.

3. The apparatus of claim 2, wherein the plurality of tubes are positioned in a tube forest disposed on opposite sides of the conveyor, the tube forest comprising:

an upper tube forest section comprising a plurality of longitudinally spaced rows, each row comprising a plurality of transversely spaced tubes, wherein the tubes in each row are transversely spaced from the tubes in any immediately longitudinally adjacent row of tubes; and a lower forest section comprising a plurality of longitudinally spaced rows, each lower forest section row comprising a plurality of transversely spaced tubes, wherein the tubes in each lower forest section row are transversely spaced from the tubes in any immediately longitudinally adjacent lower forest section row;

wherein the upper forest section rows are longitudinally spaced from the lower forest section rows.

4. The apparatus of claim 3, wherein the tubes within each upper forest section row and lower forest section row are transversely spaced approximately 2½" apart, the upper forest section rows are longitudinally spaced approximately 6" apart, the lower forest section rows are longitudinally spaced approximately 6" apart, the upper forest section rows are longitudinally spaced approximately 3" from the lower forest section rows, and the tubes of each upper forest section row are transversely spaced approximately 1¼" from the tubes of any immediately longitudinally adjacent lower forest section row.

5. The apparatus of claim 1, wherein each zone further comprises at least one exhaust outlet allowing moisture-laden gas to be expelled from the zone.

6. The apparatus of claim 5 further comprising at least one exhaust fan that expels moisture-laden gas received from the at least one exhaust outlet.

7. The apparatus of claim 1, wherein each zone further comprises a burner that heats gas within the zone to a desired temperature, wherein the burner of each zone is independently controllable so that the drying apparatus can produce a gas temperature in at least one of the dryer zones different than the gas temperature in at least one other of the dryer zones.

8. The apparatus of claim 1, wherein each zone further comprises at least one filter that receives gas flowing from the product and collects fibrous material flowing from the product.

9. The apparatus of claim 8, wherein each zone further comprises:

a differential pressure sensing means for sensing gas pressure on opposite sides of the at least one filter and for issuing a signal indicating when filter cleaning is necessary;

a friction brush that sweeps across the at least one filter in response to the signal to disengage fibrous material accumulated therein;

a tray disposed adjacent the at least one filter that collects disengaged fibrous material; and an evacuation tube that evacuates fibrous material from the tray.

10. The apparatus of claim 1, wherein the at least one conveyor comprises an endless belt extending through each of the plurality of dryer zones and continuously supporting the product.

11. The apparatus of claim 1, further comprising a plurality of dryer modules that define the plurality of dryer zones.

12. The apparatus of claim 1, wherein the at least one circulation fan of each zone is program-controlled such that the drying apparatus produces different gas-flow rates in different zones according to the type of product fed through the drying apparatus.

13. The apparatus of claim 1, wherein the tubes comprise hollow cylindrical members extending toward the product.

14. A method of drying a product supported within and fed through a drying apparatus, comprising the steps of:

supporting the product on at least one conveyor for transport through the apparatus;

circulating gas at a gas-flow rate within each of a plurality of drying zones;

directing the gas within each drying zone through a plurality of tubes toward the at least one conveyor to cause the gas to impinge upon the product, thereby tending to dry the product;

independently controlling, in each of the drying zones, circulation of gas that is to impinge upon the product, including causing a gas-flow rate at the product in at least one of the drying zones to be higher than a gas-flow rate at the product in at least one other of the drying zones, thereby tending to dry the product in said at least one zone faster than the product in said at least one other zone; and feeding the product on the at least one conveyor through each of the plurality of drying zones.

15. The method of claim 14, further comprising the step of independently controlling gas temperature within each drying zone.

16. The method of claim 15, wherein the gas temperature controlling step comprises the step of causing a gas temperature in at least one of the drying zones to be different than the gas temperature in at least one other of the drying zones.

17. The method of claim 16, further comprising the step of exhausting moisture-laden gas from at least one of the drying zones.

18. A jet tube forest having upper and lower sections disposed on opposite sides of a conveyor that feeds a product through a tubular drying apparatus, comprising:

an upper forest section comprising a plurality of longitudinally spaced rows, each row comprising a plurality of transversely spaced tubes, wherein the tubes in each row are transversely spaced from the tubes in any immediately longitudinally adjacent row; and a lower forest section comprising a plurality of longitudinally spaced rows, each lower forest section row comprising a plurality of transversely spaced tubes, wherein the tubes in each lower forest section row are transversely spaced from the tubes in any immediately longitudinally adjacent lower forest section row;

the upper forest section rows being longitudinally spaced from the lower forest section rows.

19. The jet tube forest of claim 18, wherein the tubes within each upper forest section row and lower forest section row are transversely spaced approximately $2\frac{1}{2}''$ apart, the upper forest section rows are longitudinally spaced approximately 6" apart, the lower forest section rows are longitudinally spaced approximately 6" apart, the upper forest section rows are longitudinally spaced approximately 3" from the lower forest section rows, and the tubes of each upper forest section row are transversely spaced $1\frac{1}{4}''$ from the tubes of any immediately longitudinally adjacent lower forest section row.

20. An apparatus for drying a product, comprising:

means for supporting the product within the apparatus and transporting it therethrough;

means for defining a plurality of zones that receive the product as the product is fed through the apparatus;

tube means disposed adjacent the supporting means for directing gas to impinge upon the product to tend to dry the product; and means for circulating gas that is to impinge upon the product at a variable gas flow rate at the product in at least one of the zones and for circulating gas that is to impinge upon the product at a higher variable gas-flow rate at the product in at least one other of the zones, thereby tending to dry the product in said at least one zone faster than the product in said at least one other zone.

21. The apparatus of claim 20, further comprising means for exhausting moisture-laden gas from the defining means.

22. The apparatus of claim 21, further comprising means for heating the gas within the defining means, so that the apparatus can produce a gas temperature in at least one of the zones different than a gas temperature in at least one other of the zones.

23. A drying apparatus for drying a product fed therethrough, comprising:

at least one conveyor supporting the product within the drying apparatus for transport therethrough;

at least one dryer zone, comprising:

a plurality of tubes disposed adjacent to the at least one conveyor, the tubes directing gas to impinge upon the product to tend to dry the product; and at least one circulation fan causing the gas to circulate at a gas-flow rate through the zone to the tubes;

at least one filter that receives gas flowing from the product and collects fibrous material flowing from the product;

a differential pressure sensor for sensing gas pressure on opposite sides of the at least one filter and for issuing a signal indicating when filter cleaning is necessary; and a brush that sweeps across the at least one filter in response to the signal to disengage fibrous material accumulated in the at least one filter.

24. The apparatus of claim 23, further comprising:

a tray disposed adjacent the at least one filter to collect disengaged fibrous material; and an evacuation tube coupled with the tray to evacuate fibrous material from the tray.

* * * * *